United States Patent [19]

Heinzmann

[11] 4,229,123

[45] Oct. 21, 1980

[54] INCLINED RETAINING WALL AND ELEMENT THEREFOR

[76] Inventor: Erich Heinzmann, Balfrinstrasse 17a, CH-3930 Visp, Switzerland

[21] Appl. No.: 3,987

[22] Filed: Jan. 16, 1979

[30] Foreign Application Priority Data

Jan. 18, 1978 [CH] Switzerland ..... 509/78

[51] Int. Cl.[3] ..... E02D 29/02

[52] U.S. Cl. ..... 405/273; 47/33; 52/541; 52/606; 52/608; 405/286; D25/87; D25/90; D25/91

[58] Field of Search ..... 405/284, 286, 262, 273, 405/285, 15, 16, 17, 29, 33–35, 258, 287; 52/541, 606, 608, 609; 47/33; 46/25; D25/87, 90, 91, 80, 93, 95

[56] References Cited

U.S. PATENT DOCUMENTS

| | | | |
|---|---|---|---|
| 1,736,595 | 11/1929 | Heinzman | D25/90 |
| 1,807,138 | 5/1931 | Spelshouse | 52/606 |
| 2,653,450 | 9/1953 | Fort | D25/87 |
| 2,960,797 | 11/1960 | Frehner | 405/284 |
| 3,953,979 | 5/1976 | Kurose | 405/286 |
| 4,083,190 | 4/1978 | Pey | 405/33 |

FOREIGN PATENT DOCUMENTS

| | | | |
|---|---|---|---|
| 205221 | 10/1923 | United Kingdom | 52/606 |

*Primary Examiner*—Roy D. Frazier

*Assistant Examiner*—Alexander Grosz

*Attorney, Agent, or Firm*—Heinrich W. Herzfeld

[57] ABSTRACT

An inclined retaining wall for retaining and securing the slope of an inclined piece of terrain comprises a plurality of horizontal rows of prism-shaped elements, which rows of elements are superimposed one upon the other in a relationship staggered rearwardly in upward direction. The elements of each row are spaced relative to one another leaving gaps therebetween, and a base at the foot of said inclined piece of terrain supports a lowermost row of the elements. Each element of a superimposed one of the said rows bridges a corresponding gap in the next adjacent row therebeneath and is aligned in an inclined series with an element in any second row therebeneath or thereabove. Some or all elements have a hollow soil-fillable interior open at the top end and at the bottom end of such element, whereby plants planted in the soil at the open top end of one of these elements can extend their roots through the open bottom end of that element into the soil therebeneath.

These elements are usable in upright position in the retaining wall, each element comprising a casing having a hollow soil-fillable interior open at the top end and the bottom end of the element, a front wall of the casing being destined to face away from the slope, side walls and a rear wall, and rampart means on the face of the rim of the open top end being positioned centrally on the said front wall of the element.

14 Claims, 7 Drawing Figures

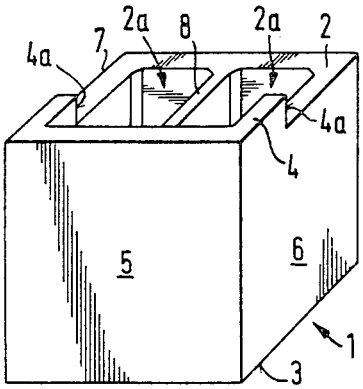
Fig. 1
Fig. 3
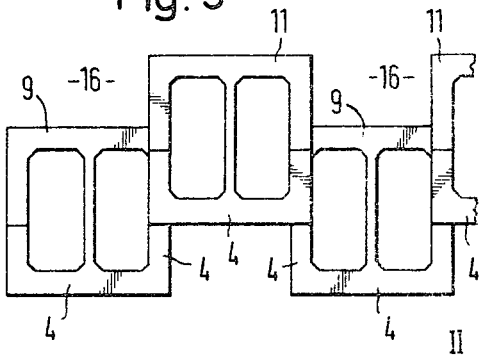
Fig. 2
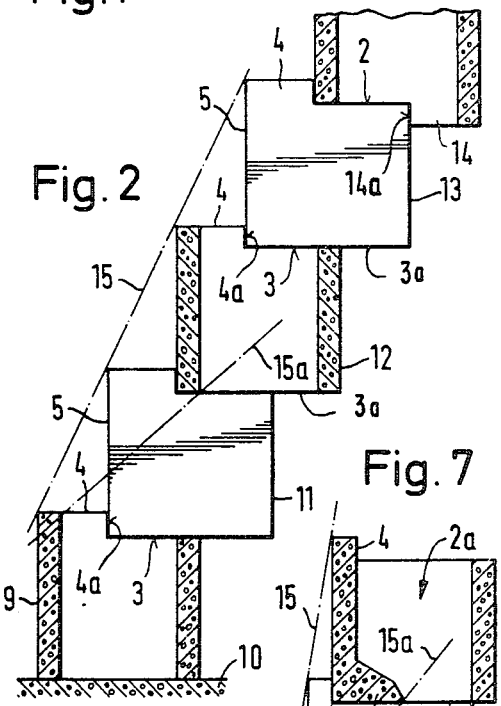
Fig. 4
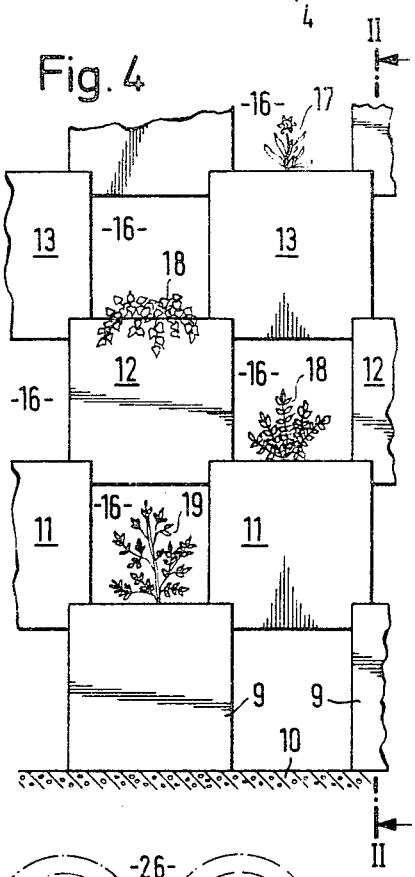
Fig. 7
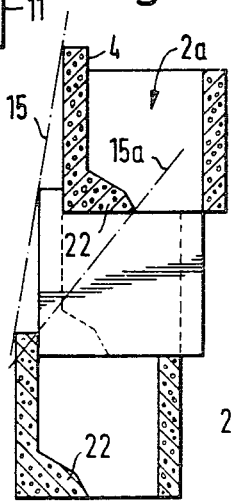
Fig. 5
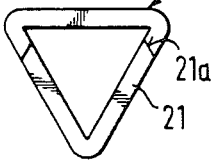
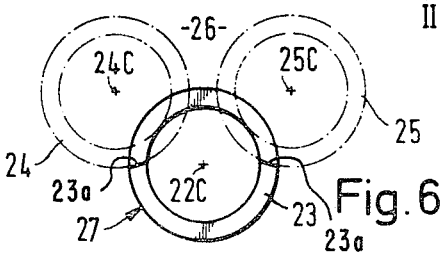
Fig. 6

INCLINED RETAINING WALL AND ELEMENT THEREFOR

BACKGROUND OF THE INVENTION

This invention relates to an inclined retaining wall for retaining and securing the slope of an inclined piece of terrain, comprising a plurality of horizontal rows of prism-shaped elements which rows of elements are superimposed one upon the other in a relationship staggered rearwardly in upward direction. The invention also relates to a prism-shaped element which is usable in upright position in the aforesaid retaining wall.

Such walls are used especially to retain and secure road escarpments, garden terrasses or the like having steep angles of slope which require securing against sliding or slumping of the soil.

Conventional walls serving to prevent this are made of various types of concrete or as solid masonry made of freestones or ashlars, preferably bound with mortar.

Instead of a solid masonry, structures of slope-securing walls are also known which give an optical impression of being lighter and which permit the planting of flowers and the like in the masonry, for instance walls built of concrete lozenges wherein each lozenge has a window.

However, solid walls in particular are expensive as they require large amounts of material and always create a foreign, and hence often a disturbing impression in an otherwise natural landscape. Their use in conserving natural slopes of terrain, e.g. in National Parks is therefore often problematic.

It is also known to use individual shell or bucket structures. These structures are satisfactory where the slope is not too steep and/or the pressure of the terrain behind the wall is not too high and where only small plants are to be planted on the slope.

A further known type of slope-securing means comprises a wall or cover made of concrete slabs at least some of which are provided with anchoring means. However, the planting of flowers, shrubs or trees in such a wall to camouflage it is difficult. Moreover, securing high slopes is rendered difficult by the fact that the structures are not sufficiently stable and slabs therein have a tendency to tilt. Furthermore, such wall structures suffer from the drawback that rupture of a slab thereof involves the risk of destruction of all slabs therebeneath by falling slab parts and soil material, thus rendering the securing of the slope in this sector illusory.

OBJECTS AND SUMMARY OF THE INVENTION

It is therefore a primary object of the present invention to provide an inclined retaining wall for the desired purposes, and novel elements for its construction, which permit saving construction material, the wall being therefore less expensive than comparable known structures.

It is another object of the invention to provide a retaining wall of the type described which is simple to assemble without requiring the use of mortar or cement.

It is a further object of the present invention to provide a retaining wall of the initially described type in which plants of various sizes and types such as flowers, shrubs and trees can be planted, thereby enhancing the possibility of fitting the wall optically well into a natural landscape.

It is yet another object of the present invention to provide an inclined retaining wall of the initially described type built from elements which are easy and inexpensive to manufacture and permit their easy assembly as walls of random length and height which can be adapted to a given angle of slope and at the same time offer the possibility of stabilizing a slope of the terrain by a combination of artificial and natural means.

It is still another object of the invention to provide an inclined retaining wall of the initially described type wherein special anchoring means are rendered largely or completely superfluous.

Yet another object of the invention is to provide an element for the construction of an inclined retaining wall of the initially described type which element can be prefabricated and easily transported to the construction site of the wall.

These objects are attained in a retaining wall of the initially described type which is improved according to the invention by the elements of each row being spaced relative to one another leaving gaps therebetween, a base destined to be laid at the foot of the said inclined piece of terrain, on which base a lowermost row of the elements is supported, each element of a superimposed one of the said rows bridging a corresponding gap in the next adjacent row therebeneath and being aligned in an inclined series with an element in any second row therebeneath or thereabove.

At least some or preferably all elements can have a hollow soil-fillable interior open at the top ends and at the bottom ends of the elements, whereby plants planted in the soil at the open top end of one of the elements can extend their roots through the open bottom end of that element into the soil therebeneath. Each of the elements can have a rim face about its open top end and a rampart projecting upwardly from that rim face and extending along a central frontal portion of the rim face destined to face away from the slope, the height of each element pertaining to one of the inclined series and the extension of the rampart of each of the elements toward the rear defining a determined slope angle of the said retaining wall.

In another aspect, the prism-shaped elements usable in the above-described wall comprise:

(a) a casing having a hollow soil-fillable interior open at the top end and the bottom end of the element, and (b) rampart means at least on the face of the rim of the open top end, being positioned centrally on the front wall of the casing destined to face away from the slope, and the casing further comprises side walls adjacent the front wall and a rear wall.

The rampart means preferably extend rearwardly from the central position on the rim face by equal lengths along the rims of the side walls of the casing. The two ends of the rampart means on the rim face about the open top end of the casing preferably form steps with the remaining part of the said rim face which steps have faces perpendicular to the last-mentioned rim face and destined to face toward the slope.

The casing can further comprise one or several transverse vertical walls dividing the interior of the element into two or more chambers. When a plurality of transverse walls are provided, the rampart means preferably extend rearwardly from their central position on the front rim of the open top end of the casing by equal lengths on the rims of those two of the aforesaid transverse walls which are next adjacent a side wall of said casing.

Additional rampart means can be positioned on the face of the rim about the open bottom end of the element and are preferably diagonally opposite the rampart means on the rim face of the open top end.

The casing can have a polygonal, preferably a rectangular cross-section, or, for instance, a triangular cross-section with rounded corners, a pentagonal or hexagonal cross-section, or it can be cylindrical, then having preferably a circular cross-section. In the case of a triangular cross-section, the latter has preferably isosceles configuration. The end faces of the rampart means then are preferably parallel to the opposite side walls of the triangle to permit a snug fit of the outer faces of superimposed elements abutting against these end faces. When the casing has circular cross-section, the rampart means preferably cover about half of the face of the rim about the open top end of the element and the step faces of the rampart means preferably have concavely curved cross-section. The centers of curvature at the two ends of such rampart means preferably form together with the center of the circle of the casing cross-sectional area an isosceles triangle having a base which is larger than the diameter of the said circular cross-sectional area.

The casing can furthermore have a foot-shaped portion on the inside of the casing front wall which portion serves for taking up pressures exerted under the angle of inclination formed by the securing wall when the said elements form the said wall against pressures under the given angle of slope.

Preferably, the casing of the element according to the invention is made of concrete or reinforced concrete, and the rampart means are preferably made integral with the casing.

In a particularly preferred mode of carrying out the invention in practice, an inclined plant-bearing wall is secured to the soil of a slope of an inclined piece of terrain for retaining the said slope, and comprises a plurality of horizontal rows of prism-shaped elements according to the invention in the above-described arrangement and has some or all elements filled with soil, and further comprises plants planted in the soil at the open top ends of some or all of the elements, the roots of which plants extend through the open bottom end of each plant-bearing element into the soil of the slope beneath such plant-bearing element.

BRIEF DESCRIPTION OF THE DRAWING

The invention is described in more detail with reference to the accompanying drawing in which:

FIG. 1 is a perspective view of a preferred embodiment of the slope-securing element according to the invention, FIG. 2 shows in cross-sectional view a slope-securing wall portion composed of a plurality of elements of the embodiment shown in FIG. 1, FIG. 3 is a top view of a zone of the slope-securing wall portion, FIG. 4 is a frontal view of the wall portion shown in FIGS. 2 and 3, line II—II indicating the cross-sectional plane of FIG. 2, FIG. 5 is a top view of a second embodiment of the slope-securing element according to the invention, FIG. 6 is a top view of a third embodiment of the slope-securing element according to the invention, and FIG. 7 shows a slope-securing wall portion made of a plurality of elements of yet a further embodiment similar to that shown in FIG. 1.

DETAILED DESCRIPTION OF THE DRAWING

The embodiment of a slope-securing element according to the invention shown in FIG. 1 consists of an oblong casing 1, preferably made of concrete or reinforced concrete. The casing 1 has a rim 2 about its open top end 2*a* and a rim 3 about its lower open end 3*a;* the faces of these rims are in planes approximately parallel to one another. A rampart 4 projects upwardly from upper rim 2 over part of the rim circumference in such a manner that it forms the upper part of the rectangular front wall 5 and extends rearwardly therefrom by equal lengths on the rims of side walls 6 and 7. The ends of rampart 4 on side walls 6 and 7 form steps the faces 4*a* of which are preferably perpendicular to the face of rim 2. The space enclosed by casing 1 is divided into two chambers of equal size by a transverse wall 8 being of the same height as the rampart-free parts of the side walls 6 and 7 of casing 1.

A slope-retaining and securing wall (FIGS. 2 to 4) can be formed by combining several securing elements shown in FIG. 1 preferably in the following manner:

A horizontal base row of elements 9 is set up, preferably on a concrete slab 10 which can be slightly inclined downwardly in rearward direction, i.e. toward the slope, to help compensate slope pressure. Slab 10 is preferably cast, e.g. as a reinforcement onto or into the slope, and the elements of this base row are spaced from one another by a distance, between neighboring side walls 6 and 7 of two elements 9, which is not larger than the inner width of element 9, measured from the internal face of side wall 6 to the internal face of side wall 7.

A second row is set upon the base row of elements 9, having its elements 11 displaced horizontally and rearwardly with respect to the elements 9 of the base row. Front sides 5 of second row elements 11 bridge the gaps between base row elements 9 and their corners rest against the rearward end faces 4*a* of ramparts 4 of base row elements 9. A third row of elements 12 is set upon second row elements 11 in a similar manner and its elements 12 are consequently above and aligned with the first row elements 9. Elements 13 constituting a fourth horizontal row are placed on third row elements 12 and are above and aligned with second row elements 11, etc.

The superimposed elements of these horizontal rows which appear to the viewer as being in vertical alignment with each other constitute inclined series of rearwardly staggered elements. The front view of the slope-securing wall composed of these elements thus presents a pattern of slightly overlapping elements and narrower free interspaces 16 forming gaps in the wall (FIG. 4).

When several elements according to the invention are superimposed as described hereinbefore, the length of the ramparts on side walls 6 and 7 of individual elements and the height of the latter determine the angle of inclination 15 (FIG. 2) of the wall securing the slope of a hill or the like inclined terrain. Hence, varying the said length of the ramparts and heights of the elements allows adjustment of the inclination of the supporting wall to different slope angles.

In order to achieve a better reinforcement against a forward displacement of superimposed elements relative to one another, the elements can have ramparts 14 (FIG. 2) disposed at their lower rear ends, e.g. diagonally opposite ramparts 4, which preferably have the same configuration as the latter. The forward end faces 14*a* of rampart 14 engage the upper rear end portion of element 13 in the same manner as end faces 4*a* of rampart 4 engage the forward part of lower end 3 of the element superimposed on element 13 in FIG. 2.

By filling the individual elements with soil, rocks or the like, they are made so heavy that they cannot slide out of place and are able to resist even unusually large downward and forwardly directed slope pressures. For the same purpose, the casing walls can be made thicker and concrete iron reinforcements can be inserted in the casing (not shown).

By arranging the elements which have open upper and lower end faces as in a checkerboard, every four neighbouring elements define between them a slanted slope area or window 16, the angle of inclination 15*a* (FIG. 2) of which area is substantially smaller than the angle of inclination 15 of the slope itself; angle 15*a* is determined by the geometrical arrangement of the corresponding (inner or outer) upper and lower edges of elements 9 superimposed in the same inclined series bordering slope area 16.

Flowers 17, shrubs 18 or even small trees 19 can be planted in the soil of the free slope areas accessible in windows 16 between elements (FIG. 4). Because the elements 11,12 and 13 which are filled with earth have open upper and lower ends and the parts of the lower ends which project over the upper ends of the underlying elements 9,11 and 12, respectively, open into the soil behind the securing wall, plants set in the intermediate slope areas 16 can have their roots grow downward into the soil of the slope, thus achieving an additional, natural support of the slope.

The elements according to the invention do not have to be secured to the slope by anchors attached to their side walls 6 and 7 and penetrating rearward or downward into the slope, because the elements are secured against a forward movement away from the slope by their own weight including the weight of the filling material and by the abutment of upper elements against the ramparts of underlying elements, the lowermost of which rest securely on their concrete foundation; a lateral displacement is impeded by soil resting against side walls 6 and 7 in gaps 16 as well as at the outer end side walls of the terminal elements of each horizontal row which latter can be secured against sliding displacement by anchors in a manner known per se.

The casing of the element shown in FIG. 1 can have two transverse walls instead of only one, which divide it into three chambers of equal width and length, and each can bear ramparts 4, while the side walls 6 and 7 can be left free of ramparts; the securing wall is then built in a slightly different manner by placing the side walls of second row elements on the transverse walls of the base row elements instead of placing them only on the rims 2 of casings 1. Securing walls built in this manner with the said three-chamber elements are preferable when the slope consists of material having a tendency to slide easily, for instance clay.

By providing at least the front surface of each element with an ornamental configuration, for instance recesses and projections, e.g. grooves and ribs, the elements can be made to look attractive. Colored concrete, concrete containing pebbles, etc. can also be used for this purpose.

Polygonal or rounded elements can be used instead of the oblong elements of FIG. 1. Thus, the element in FIG. 5 is a prism having a triangular cross-sectional area with rounded corners. The cross-sectional area can be an equilateral or preferably an isosceles triangle. In the latter case it is of importance to provide ramparts 21 on the end where the isosceles sides meet. Rampart 21 is integral with and preferably covers more than half of the triangular-shaped upper rim face of element 20 (FIG. 5). Each step face 21*a* at the ends of rampart 21 is parallel to the opposite side walls of the triangle so that the second row elements can be built on the first row elements in a compact manner, the rampart end faces of the latter abutting snugly against the outer walls of the former.

FIG. 6 shows a cylindrical element 22 of circular cross-section; its rampart 23 preferably covers about one half of the upper circumferential rim of the element and has at its ends step faces 23*a* of concavely curved cross-section. The centers of the curvature 24C and 25C at the two ends of rampart 23 form, together with the center 22C of the circle constituted by a cross-section of element 22, an isosceles triangle the base of which is larger than the diameter of the circular cross-section of the cylindrical element 22. Thereby, two cylindrical elements 24 and 25 (shown in phantom lines in FIG. 6) of the next superimposed row of elements come to rest snugly against the rampart end faces 23*a* and leave a gap 26 between them.

FIG. 7 shows in cross-sectional view a securing wall which is composed of oblong elements that are comparable with those shown in FIG. 2. However, the rampart 4 is formed only on the upper frontal wall rim of the casing 1 and does not extend over the side walls 6 and 7; consequently, when the second row elements are placed on the base row elements, they cover much more upper surface area and a steeper angle of inclination is achieved by the securing wall which is therefore adapted for securing more steeply inclined slopes than those secured by the wall shown in FIG. 2. On the inside of the casing front wall 5, each element is provided with a foot-shaped portion 22 for taking up pressures exerted under the angle of inclination 15*a* formed by the securing wall against pressures under the angle of the slope 15.

Instead of having the rampart 4 extend over the entire length of the top rim face of front wall 5, this rampart can be interrupted to extend only a short distance along that top rim face from each of the corners of the latter formed with side walls 6 and 7, thereby saving material. However, an undesirable cascade effect may then result as the soil is not held back in the recessed rim portion between the two corner segments of the rampart, and the front face 5 can consequently be dirtied by drying soil sedimented from overflowing rain water.

The slope-securing elements according to the invention for building retaining or securing walls to protect sloped terrain against slumps or minor slides and "down-wasting" of the soil, have the great advantage that less material is needed for their construction due to the provision of the gaps between individual elements and that an effective and attractive securing wall adapted to a given inclination of a slope can be built without the use of special equipment. The natural reinforcement of slopes is facilitated by the growth of roots from plants set in the free slope areas or windows between the elements. These free slope areas are naturally humidified by rainfall. The need for irrigation is therefore reduced or eliminated. Canals formed in a manner known per se at the base of the securing wall can provide a run-off for excess rainwater. The plants can obtain moisture through their roots and do not have to rely on moisture from the rear, i.e. the slope. By correspondingly choosing the geometrical dimensions of the elements, an adaptation of the slope of the open terrain to the inclination achievable with a given type of material is possible which is independent of a given slope angle. Further advantages of the invention are a simple and economic manufacture of the elements according to the invention and their simple storage.

Slope-retaining walls according to the invention are particularly suited for restoring the aspect of a natural landscape to a strip-mined area.

Inclined retaining walls according to the invention can of course be applied to inclined pieces of terrain having a relatively low angle of slope; their use is recommended when that angle of slope is 30° and higher and particularly for angles of slope between 45° and 85°.

I claim:

1. An inclined retaining wall secured to the soil of a slope of an inclined piece of terrain for covering, retaining and securing said slope, said wall being adapted for having plants planted therein and permitting the roots of said plants to grow downward into the soil of said slope, said wall comprising a plurality of horizontal rows of prism-shaped elements, said rows of elements being superimposed one upon the other in a relationship staggered rearwardly in upward direction, said elements of each row being spaced relative to one another leaving gaps therebetween, a concrete or stone base at the foot of said slope on which base a lowermost row of said elements is supported, each element of superimposed one of said rows bridging a corresponding gap in the next adjacent row therebeneath and being aligned in an inclined series with an element in any second row therebeneath or thereabove; each of said prism-shaped elements comprising:

(a) a casing having a hollow soil-fillable interior open at the top end and the bottom end of said elememt, a front wall zone of said casing being destined to face away from said slope, and said casing further comprising side wall zones adjacent said front wall zone, and a rear wall zone, and (b) rampart means at least on the face of the rim of said open top end, protruding upwardly above said rim face and being positioned centrally on said front wall zone, said rampart means extending rearwardly from said central position on said rim face on the rims of said side wall zones; the two ends of said rampart means on said rim face about said open top end of the casing forming steps with the remaining part of the said rim face which steps comprise abutment faces perpendicular to the last-mentioned rim face and destined to face toward the slope, all the remaining portion of said rim face on the top open end of said casing to the rear of said perpendicular abutment faces extending in a single horizontal plane, and the rim face about the open bottom end of said element being in a single horizontal plane.

2. The element of claim 1, wherein said casing further comprises one or several transverse vertical walls dividing said interior into two or more chambers.

3. The element of claim 1, wherein additional rampart means are positioned on the face of the rim about said open bottom end diagonally opposite said rampart means on the face of the rim of said open top end.

4. The element of claim 1, wherein said casing has a polygonal cross-section.

5. The element of claim 1, wherein said casing has a rectangular cross-section.

6. The element of claim 1, wherein said casing has a triangular cross-section with rounded corners.

7. The element of claim 6, wherein said triangular cross-section has isosceles configuration.

8. The element of claim 6, wherein said end faces of said rampart means are parallel to the opposite side wall zones of the triangle.

9. The element of claim 1, wherein said casing has circular cross-section and said rampart means cover about half of said face of the rim of said open top end and said step faces have concavely curved cross-section.

10. The element of claim 9, wherein the centers of curvature at the two ends of said rampart means form together with the center of the circle of said cross-section an isosceles triangle having a base which is larger than the diameter of said circular cross-section.

11. The element of claim 1, wherein said casing has a foot-shaped portion on the inside of said casing front wall zone for taking up pressures exerted under the angle of inclination formed by the securing wall when said elements form said wall against pressures under the angle of said slope.

12. The element of claim 1, wherein said casing is made of a material from the group consisting of concrete or reinforced concrete.

13. The element of claim 1, wherein said rampart means are integral with said casing.

14. An inclined retaining wall secured to the soil of a slope of an inclined piece of terrain for covering, retaining and securing said slope, said wall being adapted for having plants planted therein and permitting the roots of said plants to grow downward into the soil of said slope, said wall comprising a plurality of horizontal rows of prism-shaped elements, said rows of elements being superimposed one upon the other in a relationship staggered rearwardly in upward direction, said elements of each row being spaced relative to one another leaving gaps therebetween, a concrete or stone base at the foot of said slope on which base a lowermost row of said elements is supported, each element of a superimposed one of said rows bridging a corresponding gap in the next adjacent row therebeneath and being aligned in an inclined series with an element in any second row therebeneath or thereabove; each of said prism-shaped elements comprising:

(a) a casing having a hollow soil-fillable interior open at the top end and the bottom end of said element, a front wall zone of said casing being destined to face away from said slope, and said casing further comprising side wall zones adjacent said front wall zone, and a rear wall zone, and (b) rampart means at least on the face of the rim of said open top end, protruding upwardly above said rim face and being positioned centrally on said front wall zone, said rampart means extending rearwardly from said central position on said rim face on the rims of said side wall zones; the two ends of said rampart means on said rim face about said open top end of the casing forming steps with the remaining part of the said rim face which steps comprise abutment faces perpendicular to the last-mentioned rim face and destined to face toward the slope, all the remaining portion of said rim face on the top open end of said casing to the rear of said perpendicular abutment faces extending in a single horizontal plane, and the rim face about the open bottom end of said element being in a single horizontal plane, whereby each element of a superimposed row can bridge a gap between a first and a second supporting element in a row therebelow by resting with its bottom rim face in the top one of said side wall zones, the rearward portion of the rim face on said first supporting element and with its bottom rim face in its other side wall zone on the rearward portion of the top rim face of the second supporting element, while abutting with its front wall zone near its bottom end against perpendicular abutment faces on the top end rim faces of said first and of said second supporting elements adjacent the gap between the latter two elements, and while the open bottom end of said superimposed element is in free communication with the soil surface of said slope.

* * * * *